US007549931B1

(12) United States Patent
Faulk

(10) Patent No.: US 7,549,931 B1
(45) Date of Patent: Jun. 23, 2009

(54) MODIFIED CHESS SET AND METHOD OF PLAYING A MODIFIED GAME OF CHESS

(76) Inventor: William L. Faulk, P.O. Box 191848, Los Angeles, CA (US) 90019

( * ) Notice: Subject to any disclaimer, the term of this patent is extended or adjusted under 35 U.S.C. 154(b) by 70 days.

(21) Appl. No.: 11/536,207

(22) Filed: Sep. 28, 2006

(51) Int. Cl.
*A63F 3/00* (2006.01)

(52) U.S. Cl. ..... 473/260; 273/261; 273/262

(58) Field of Classification Search ..... 273/260, 273/261
See application file for complete search history.

(56) References Cited

U.S. PATENT DOCUMENTS 3,700,242 A 10/1972 Sterler
4,093,237 A 6/1978 Weiss
D252,713 S 8/1979 Weiss
RE32,716 E * 7/1988 Corinthios ..... 273/260
5,280,913 A 1/1994 Sirk
2002/0101033 A1 8/2002 Pellegrini et al.
2003/0085521 A1 5/2003 Grady

* cited by examiner

*Primary Examiner*—Vishu K. Mendiratta

(57) ABSTRACT

A modified chess set and method of playing the same includes a chessboard comprising nine ranks and nine files of checkered alternating colored squares. A first set of chess pieces including nine pawns, two rooks, two knights, two bishops, two princes and one king. A second set of chess pieces including nine pawns, two rooks, two knights, two bishops, two princes and one king. The first set of chess pieces are visually distinguishable from the second set of chess pieces.

1 Claim, 1 Drawing Sheet

MODIFIED CHESS SET AND METHOD OF PLAYING A MODIFIED GAME OF CHESS

BACKGROUND OF THE INVENTION

1. Field of the Invention

The present invention relates to modified chess games and more particularly pertains to a new modified chess game for providing additional challenge to a game of chess.

2. Description of the Prior Art

The use of modified chess games is known in the prior art. While these devices fulfill their respective, particular objectives and requirements, the need remains for a system and method that includes has certain improved features that provide 2 additional pieces per player to vary the game of chess and provide additional difficulty to the game. Additionally, each set of chess pieces includes a pair of princes that can move and capture as a queen from a standard game of chess.

SUMMARY OF THE INVENTION

The present invention meets the needs presented above by generally comprising a chessboard with nine ranks and nine files of checkered alternating colored squares. A first set of chess pieces including nine pawns, two rooks, two knights, two bishops, two princes and one king. A second set of chess pieces including nine pawns, two rooks, two knights, two bishops, two princes and one king. While the pieces common to conventional chess include their common movements, each of the princes can be moved in a straight line along the ranks, files or diagonals of the squares for as many squares as selected by a player. The first set of chess pieces being visually distinguishable from the second set of chess pieces.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
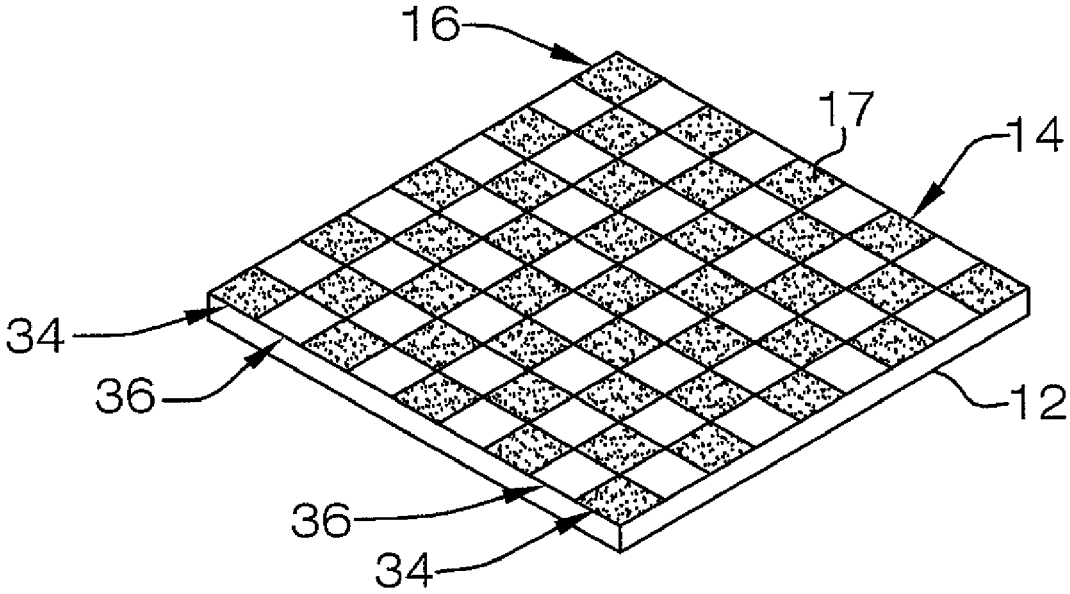
FIG. 1 is a perspective view of a chessboard of a modified chess set according to the present invention.
Figure 2:
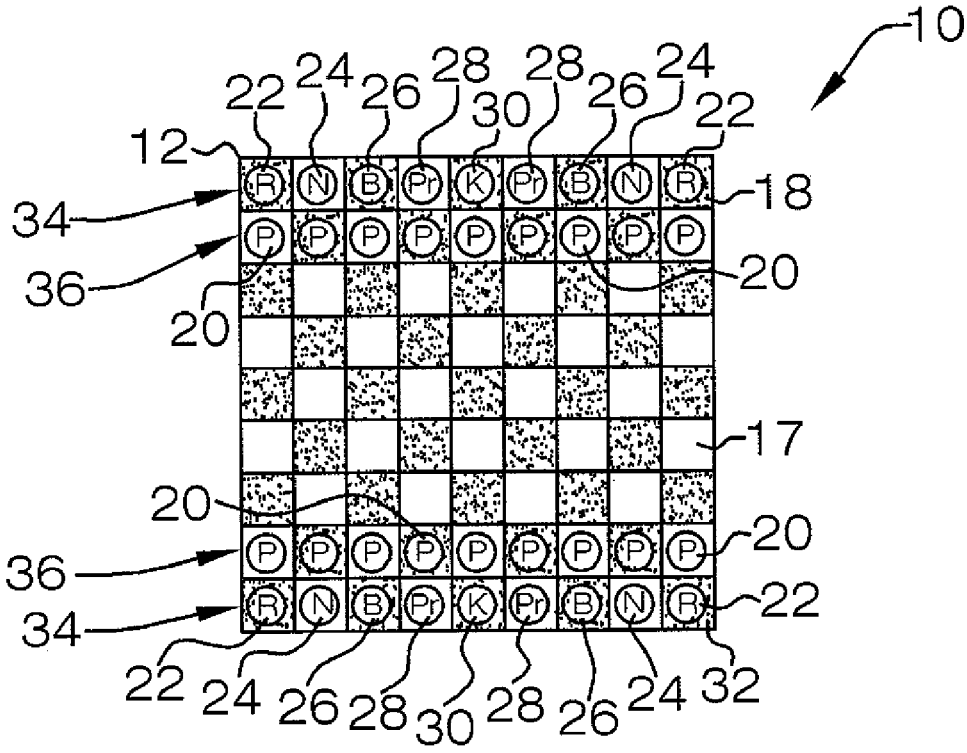
FIG. 2 is a top view of the present invention.

With reference now to the drawings, and in particular to FIGS. 1 and 2 thereof, a new modified chess game embodying the principles and concepts of the present invention and generally designated by the reference numeral 10 will be described.

As best illustrated in FIGS. 1 and 2, the modified chess set 10 generally comprises a chessboard 12 of nine ranks 14 and nine files 16 of checkered alternating colored squares 17. A first set of chess pieces 18 includes nine pawns 20, two rooks 22, two knights 24, two bishops 26, two princes 28 and one king 30. A second set of chess pieces 32 includes nine pawns 20, two rooks 22, two knights 24, two bishops 26, two princes 28 and one king 30. The first set of chess pieces 18 is visually distinguishable from the second set of chess pieces 32, such as the first set of chess pieces 18 being of a different color than the second set of chess pieces 32.

It should be understood that each of the chessboard 12, first set of chess pieces 18 and second set of chess pieces 32 may be provided in a digital display format as well, as provided by a computer or video game console and displayed on an electronic display. Players using electronic input devices such a game controller or keyboard, would actuate all game piece movement as described below.

The method of playing a modified game of chess includes the players choosing which of the players is to play first. The first set of chess pieces 18 is taken by the player to go first and the second set of chess pieces 32 is taken by the other player. Each of the sets of chess pieces 18, 32 is placed on the chessboard 12 by each of the players. The ranks 14 closest to each of the players are designated as royal ranks 34. The rooks 22 are placed at opposing ends of the associated one of the royal ranks 34. The knights 24 are placed into the associated one of the royal ranks 34 and into the squares 17 positioned adjacent to the rooks 22. The bishops 26 are placed into the associated one of the royal ranks 34 and into the squares 17 positioned adjacent to the knights 24. The princes 28 are placed into the associated one of the royal ranks 34 and into the squares 17 positioned adjacent to the bishops 26. The king 30 is placed into the associated one of the royal ranks 34 and into the square positioned between the princes 28. The ranks 14 adjacent to the royal ranks 34 are designated as pawn ranks 36. The pawns 20 are placed into each of the squares 17 of the associated one of the pawn ranks 36.

A game of chess is initiated with the players alternating turns of play. Upon an initial turn of each of the players may choose to switch positioning of one of the bishops 26 for an adjacently positioned one of the knights 24 to position the bishops 26 of the associated one of the sets of chess pieces 18, 32 on squares 17 of different colors. Each of the players in turn then chooses one of the chess pieces of the associated one of the sets of chess pieces 18, 32 to be moved.

Each of the bishops 26 may be moved to any of the squares 17 along a diagonal including the square 17 on which the associated one of the bishops 26 is positioned. Each of the rooks 22 may be moved to any of the squares 17 along one of the ranks 16 or one of the files 16 including the square 17 on which the associated one of the rooks 22 is positioned. Each of the princes 28 may be moved to any of the squares 17 along one of the ranks 16, one of the files 16 or one of the diagonals including the square 17 on which the associated one of the princes 28 is positioned on. The rooks 22, the bishops 26 and the princes 28 are not allowed to move over any intervening pieces.

Each of the knights 24 may be moved to any of the squares 17 nearest to the square 17 occupied be the associated one of the knights 24 but is not in the same the rank 14, the same file 16 or one of the diagonals including the square 17 occupied by the associated one of the knights 24. Additionally, the knights 24 are allowed to move over any intervening pieces.

The king 30 may be moved to any of the squares 17 being positioned adjacent to the square 17 occupied by the king 30 as long as the chosen one of the squares 17 does not place the king 30 in check. Castling is possible when neither the king 30 nor the one rook 22 to be used in the castling have been moved from their starting position and there are no chess pieces 18 between the king 30 and the rook 22. Castling takes place by moving the king 30 two squares 17 to the right or left towards the rook 22 to be used and the rook 22 is moved to the square 17 adjacent to the king 30 on the opposite side of the king 30 from the rook's 22 initial position. One of the chess pieces 18 controlled by an opponent may be captured when one of the rooks 22, the knights 24, the bishops 26, the princes 28 or the king 30 moves into one of the squares 17 occupied by one of the chess pieces 18 controlled by the opponent during movement of one of the rooks 22, the knights 24, the bishops 26, the princes 28 or the king 30.

Each of the players may choose to move one of the pawns 20 forward a maximum of two of the squares 17 in the file 16 occupied by the associated one of the pawns 20 during initial movement of the associated one of the pawns 20. All subsequent moves of the associated one of the pawns 20 is of one square 17 in the file 16 occupied by the associated one of the pawns 20 when the associated one of the pawns 20 is selected during a players turn. One of the chess pieces 18 controlled by the opponent may be captured by one of the pawns 20 when the associated one of the chess pieces 18 is positioned diagonally forward of the associated one of the pawns 20 and on an adjacent file 16 to the associated one of the pawns 20. Additionally, a player may use a 'en pass ante' capture to capture one the pawns 20 controlled by the opponent when condition for the 'en pass ante' capture are met. A pawn 20 is promoted and replaced with either a rook 22, a knight 24, a bishop 26 or a prince 28 upon the pawn 20 reaching the royal rank 34 on the opponents side of the chessboard 12.

The players continue alternating turns. The chess game is won by one of the players when one of the players position their associated chess pieces to place the king 30 controlled by the opponent into checkmate. As can be seen from above, the game is generally played with the same rules as conventional chess with the exception that the board is larger, each player has an additional pawn, and two princes replace the one queen. The addition of two princes having the same movement capabilities of a traditional queen will require more and different forethought when moving. Further, the larger size of the board will give pause to those highly skilled players who are used to viewing a smaller board with less movement possibilities.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a modified chess game comprising:

providing a modified chess game comprising:

a chessboard comprising nine ranks and nine files of checkered alternating colored squares;

a first set of chess pieces including nine pawns, two rooks, two knights, two bishops, two princes and one king;

a second set of chess pieces including nine pawns, two rooks, two knights, two bishops, two princes and one king;

said first set of chess pieces being visually distinguishable from said second set of chess pieces;

choosing by players which of the players is to play first;

taking of said first set of chess pieces by the player to go first and taking of said second set of chess pieces by the other player;

placing of said sets of chess pieces on said chessboard by each of the players;

designating said ranks closest to each of the players as royal ranks;

placing of said rooks at opposing ends of the associated one of said royal ranks;

placing of said knights into the associated one of said royal ranks and into said squares positioned adjacent to said rooks;

placing of said bishops into the associated one of said royal ranks and into said squares positioned adjacent to said knights;

placing of said princes into the associated one of said royal ranks and into said squares positioned adjacent to said bishops;

placing of said king into the associated one of said royal ranks and into said square positioned between said princes;

designating said ranks adjacent to said royal ranks as pawn ranks;

placing of said pawns into each of said squares of the associated one of said pawn ranks;

initiating a game of chess with the players alternating turns of play;

choosing upon an initial turn of each of the players to switch positioning of one of said bishops for an adjacently positioned one of said knights to position said bishops of the associated one of said sets of chess pieces on said squares of different colors;

selecting of one of said chess pieces of the associated one of said sets of chess pieces by each of the players during their turn;

moving of one of said bishops to any of said squares along a diagonal including said square on which the associated one of said bishops is positioned on when one of said bishops is selected during one of the payers turns;

moving of one of said rooks to any of said squares along one of the ranks or one of the files including said square on which the associated one of said rooks is positioned on when one of said rooks is selected during one of the payers turns;

moving of one of said princes to any of said squares along one of the ranks, one of the files or one of the diagonals including said square on which the associated one of said princes is positioned on when one of said princes is selected during one of the players turns;

moving of one of said knights to any of said squares nearest to said square occupied be the associated one of said knights but is not in the same the rank, the same file or one of the diagonals including said square occupied by the associated one of said knights when one of said knights is selected during one of the players turns;

moving of said king to any of said squares being positioned adjacent to said square occupied by said king when said king is selected during one of the players turn;

capturing of one of said chess pieces controlled by an opponent when one of said rooks, said knights, said bishops, said princes or said king moves into one of said squares occupied by one of said chess pieces controlled by the opponent during moving of one of said rooks, said knights, said bishops, said princes or said king;

choosing by the players to move said pawn forward a maximum of two of said squares in said file occupied by the associated one of said pawns during initial movement of the associated one of said pawns when the associated one of said pawns is selected during one of the players turn;

moving of one of said pawns forward one of said squares in said file occupied by the associated one of said pawns when the associated one of said pawns is selected during a players turn;

capturing of one of said chess pieces controlled by the opponent by one of said pawns when the associated one of said chess pieces is positioned diagonally forward of the associated one of said pawns and on an adjacent file to the associated one of the pawns;

continuing of the players to take turns;

winning of the chess game by one of the players when one of the players positions their associated chess pieces to place said king controlled by the opponent into checkmate.

* * * * *